US009745037B2

(12) United States Patent
Nakayama et al.

(10) Patent No.: US 9,745,037 B2
(45) Date of Patent: Aug. 29, 2017

(54) OUTBOARD MOTOR

(71) Applicant: YAMAHA HATSUDOKI KABUSHIKI KAISHA, Iwata-shi, Shizuoka (JP)

(72) Inventors: Koichi Nakayama, Shizuoka (JP); Yukinori Nose, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/057,338

(22) Filed: Mar. 1, 2016

(65) Prior Publication Data

US 2016/0257391 A1 Sep. 8, 2016

(30) Foreign Application Priority Data

Mar. 2, 2015 (JP) ..... 2015-040508

(51) Int. Cl.

| | |
|---|---|
| ***B63H 20/24*** | (2006.01) |
| ***B63H 20/28*** | (2006.01) |
| ***F02B 75/22*** | (2006.01) |
| ***F02B 61/04*** | (2006.01) |

(52) U.S. Cl.

CPC ..... *B63H 20/24* (2013.01); *B63H 20/28* (2013.01); *F02B 61/045* (2013.01); *F02B 75/22* (2013.01)

(58) Field of Classification Search

CPC ..... B63H 20/245; B63H 20/14; B63H 20/24; B63H 20/28; B63H 21/32; F02B 75/22

USPC ..... 440/88 M, 89 B, 89 H, 89 R

See application file for complete search history.

(56) References Cited

U.S. PATENT DOCUMENTS

| | | | | |
|---|---|---|---|---|
| 5,575,699 | A * | 11/1996 | Isogawa | F01N 3/28 440/89 H |
| 5,911,610 | A * | 6/1999 | Fujimoto | B63H 20/245 440/89 H |
| 9,365,275 | B1 * | 6/2016 | Habeck | B63H 20/24 |
| 2010/0041287 | A1 | 2/2010 | Woods et al. | |
| 2013/0130576 | A1 | 5/2013 | Ochiai et al. | |

(Continued)

FOREIGN PATENT DOCUMENTS

| | | |
|---|---|---|
| EP | 1 429 059 A1 | 6/2004 |
| EP | 2 594 760 A2 | 5/2013 |

OTHER PUBLICATIONS

Official Communication issued in corresponding European Patent Application No. 16157994.1, mailed on Jul. 1, 2016.

(Continued)

*Primary Examiner* — Lars A Olson

(74) *Attorney, Agent, or Firm* — Keating and Bennett, LLP

(57) ABSTRACT

An outboard motor includes an exhaust passage that discharges exhaust gases generated in a V-type engine into water from an exhaust opening. The exhaust passage includes first and second branch passages connected to cylinders and disposed inside a V-shaped line, a first upstream collecting passage connected to each of the first branch passages, a second upstream collecting passage connected to each of the second branch passages, and a downstream collecting passage connected to the first and second upstream collecting passages. A portion from an upstream end of the downstream collecting passage to a downstream end of the downstream collecting passage is disposed outside cylinder heads of the V-type engine.

10 Claims, 7 Drawing Sheets

(56) References Cited

U.S. PATENT DOCUMENTS

| | | | |
|---|---|---|---|
| 2014/0242858 | A1 | 8/2014 | Ochiai et al. |
| 2014/0322997 | A1 | 10/2014 | Ochiai et al. |

OTHER PUBLICATIONS

Nakayama, K., "V-Type Engine"; U.S. Appl. No. 15/063,612, filed Mar. 8, 2016.

* cited by examiner

OUTBOARD MOTOR

BACKGROUND OF THE INVENTION

1. Field of the Invention

The present invention relates to an outboard motor that propels a vessel.

2. Description of the Related Art

US 2014/0322997 A1 discloses an outboard motor powered by a V-type six-cylinder engine. This outboard motor is equipped with an in-bank exhaust system that discharges exhaust gases to the inside of two cylinder banks.

The exhaust device of the engine includes exhaust passages, the number of which changes in order of 6-2-1-2-1. In detail, three exhaust ports corresponding to the right cylinder bank join together at the right exhaust manifold, and three exhaust ports corresponding to the left cylinder bank join together at the left exhaust manifold. The two passages provided in the two exhaust manifolds join together at the upstream portion of the exhaust pipe, and are branched into two at the downstream portion of the exhaust pipe. The two branch passages branched at the downstream portion of the exhaust pipe pass through two cylinder heads, and join together at the cylinder body. Thereafter, the exhaust passage passes through the exhaust guide and extends from the cylinder body to the propeller.

However, in the outboard motor disclosed in US 2014/0322997 A1, since the exhaust passage is branched and then joins together again, a pressure loss of the exhaust gases, that is, resistance applied to the exhaust gases increases. This causes a decrease in the engine output and a deterioration in fuel consumption.

For example, if one of the two branch passages is closed, branching and joining together again of the exhaust passage is eliminated. However, in this case, since exhaust gases that should be discharged to the two branch passages are discharged to only one branch passage, the pressure loss of the exhaust gases increases due to a decrease in the flow passage area. In addition, since the branch passages are provided in the cylinder head and the cylinder body, the flow passage area of the branch passages cannot be significantly increased while preventing influences on other portions.

SUMMARY OF THE INVENTION

In order to overcome the previously unrecognized and unsolved challenges described above, a preferred embodiment of the present invention provides an outboard motor including an engine that includes a V-shaped cylinder body disposed along a V-shaped line defined by a first plane passing through centerlines of a plurality of first cylinders and a second plane passing through centerlines of a plurality of second cylinders, and two cylinder heads including a plurality of combustion chambers, and an exhaust passage that discharges exhaust gases generated in the engine into water from an exhaust opening.

The exhaust passage includes a plurality of first branch passages that are connected to the plurality of first cylinders, respectively, and disposed inside of the V-shaped line, a plurality of second branch passages that are connected to the plurality of second cylinders, respectively, and disposed inside of the V-shaped line, a first upstream collecting passage connected to each of the plurality of first branch passages, a second upstream collecting passage connected to each of the plurality of second branch passages, and a downstream collecting passage which includes an upstream end connected to each of the first upstream collecting passage and the second upstream collecting passage, and a downstream end connected to the exhaust opening, and in which a portion from the upstream end to the downstream end is disposed outside of the cylinder heads.

With this arrangement, exhaust gases generated in the plurality of first cylinders are discharged to the plurality of first branch passages disposed inside of the V-shaped line, and flow from each of the first branch passages to the first upstream collecting passage. Similarly, exhaust gases generated in the plurality of second cylinders are discharged to the plurality of second branch passages disposed inside of the V-shaped line, and flow from each of the second branch passages to the second upstream collecting passage. The exhaust gases inside of the first and second upstream collecting passages flow into the inside of the downstream collecting passage through the upstream end of the downstream collecting passage positioned at the junction of the first and second upstream collecting passages, and are discharged from the downstream collecting passage through the downstream end of the downstream collecting passage positioned at the exhaust opening.

Thus, the first upstream collecting passage and the second upstream collecting passage are connected respectively to the exhaust opening of the exhaust passage by one downstream collecting passage, so that a pressure loss of exhaust gases due to branching of the exhaust passage is reduced. Further, a portion from the upstream end of the downstream collecting passage to the downstream end of the downstream collecting passage is disposed outside of the cylinder heads, so that the flow passage area of the downstream collecting passage increases without being constrained by the cylinder heads. Accordingly, the engine output and fuel consumption are improved.

The outboard motor may further include a catalyst disposed in the downstream collecting passage. Exhaust gases generated in each cylinder are collected at the downstream collecting passage. The catalyst that purifies the exhaust gases is disposed in the downstream collecting passage. Therefore, exhaust gases generated in all cylinders are treated with one catalyst.

The catalyst may be disposed inside of the V-shaped line. With this arrangement, a portion of the downstream collecting passage is disposed inside of the V-shaped line, and the catalyst is disposed in the portion of the downstream collecting passage. As compared with the case where the catalyst is disposed outside of the V-shaped line, the widths of the engine and catalyst is reduced.

The catalyst may be disposed at a height lower than an upper end of the plurality of first cylinders and higher than a lower end of the plurality of first cylinders.

With this arrangement, the catalyst is disposed at a height between the upper end of the plurality of first cylinders and the lower end of the plurality of first cylinders. Since the catalyst is disposed near the engine, high-temperature exhaust gases pass through the catalyst. Therefore, when starting the engine, the temperature of the catalyst is raised to a temperature at which the catalyst is highly active in a short period of time. Further, the catalyst is disposed at a high position, so even if water flows back inside of the exhaust passage, water hardly reaches the catalyst.

The engine may further include a crankshaft rotatable around a rotation axis extending in the up-down direction. The downstream collecting passage may include an approaching portion that extends toward the crankshaft while extending downstream with respect to a flow direction of exhaust gases.

The outboard motor may further include a cooling water passage that guides cooling water to cool the outboard motor, and a first exhaust pipe and a second exhaust pipe that define portions of the downstream collecting passage and include connecting portions that are connected to each other. The cooling water passage may include a first water passage provided in the first exhaust pipe and a second water passage provided in the second exhaust pipe. The first water passage and the second water passage may be connected to each other at the connecting portions of the first exhaust pipe and the second exhaust pipe.

With this arrangement, the first water passage and the second water passage of the cooling water passage are provided in the first exhaust pipe and the second exhaust pipe that define portions of the downstream collecting passage. Therefore, the first exhaust pipe and the second exhaust pipe that guide high-temperature exhaust gases are cooled by the cooling water. Further, the first water passage and the second water passage are connected to each other by the connecting portion between the first exhaust pipe and the second exhaust pipe, so that between these, the cooling water is distributed. Therefore, a plurality of members including the first exhaust pipe and the second exhaust pipe are cooled by the same cooling water.

The outboard motor may further include a water pump that feeds cooling water into the cooling water passage. The cooling water passage may extend from the water pump to the engine via the exhaust passage.

With this arrangement, the cooling water suctioned into the water pump is guided from the water pump into the exhaust passage by the cooling water passage, and is then guided from the exhaust passage to the engine by the cooling water passage. That is, the exhaust passage is cooled by the cooling water before cooling the cylinder heads, etc. The members defining the exhaust passage normally have a heat capacity smaller than that of the engine. Therefore, by supplying cooling water having a low temperature to the exhaust passage, an increase in the temperature of the exhaust passage is reduced.

The outboard motor may further include an engine support member that supports the cylinder body of the engine. In this case, the engine support member may define a portion of the downstream collecting passage. Alternatively, the portion from the upstream end to the downstream end of the downstream collecting passage may be disposed outside of the engine support member.

The outboard motor may further include an oil pan disposed below the engine. In this case, the portion from the upstream end to the downstream end of the downstream collecting passage may be disposed outside of the oil pan.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
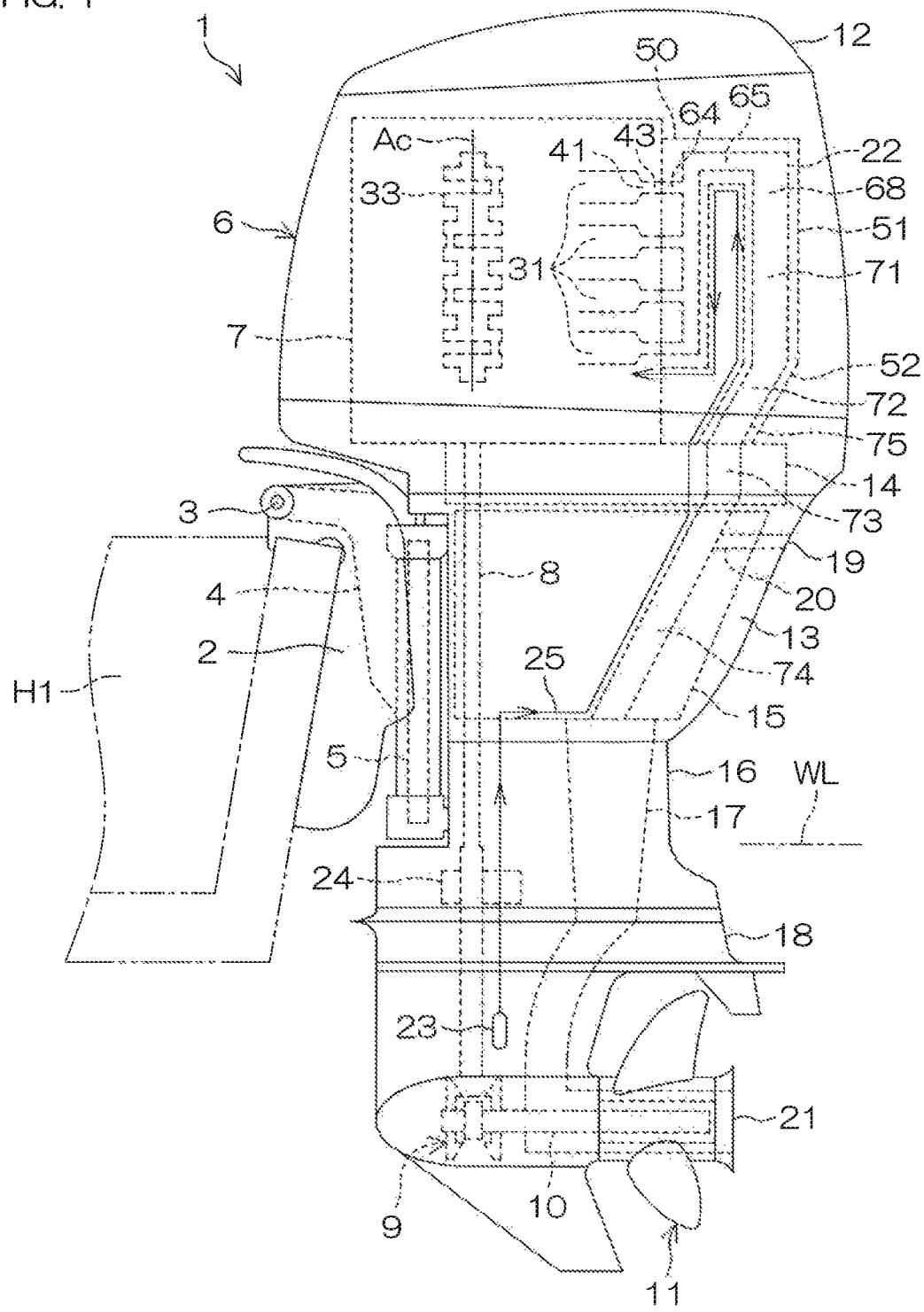
FIG. 1 is a schematic view showing a left side surface of an outboard motor according to a preferred embodiment of the present invention.

FIG. 1 is a schematic view showing a left side surface of an outboard motor 6 according to a preferred embodiment of the present invention.

A vessel propulsion apparatus 1 includes a clamp bracket 2 attachable to the rear portion (stern) of a hull H1, and an outboard motor 6 supported by the clamp bracket 2 via a tilting shaft 3, a swivel bracket 4, and a steering shaft 5. The outboard motor 6 is turnable with respect to the clamp bracket 2 around the centerline of the steering shaft 5 extending in the up-down direction, and turnable with respect to the clamp bracket 2 around the centerline of the tilting shaft 3 extending in the right-left direction.

The outboard motor 6 includes an engine 7 that is an example of an internal combustion that generates power to rotate a propeller 11, and a power transmission system that transmits the power of the engine 7 to the propeller 11. The power transmission system includes a drive shaft 8, a forward-reverse switching mechanism 9, and a propeller shaft 10. Rotation of the engine 7 is transmitted to the propeller shaft 10 via the drive shaft 8 and the forward-reverse switching mechanism 9. The direction of rotation to be transmitted from the drive shaft 8 to the propeller shaft 10 is switched by the forward-reverse switching mechanism 9. The propeller 11 rotates around the centerline of the propeller shaft 10 together with the propeller shaft 10.

The outboard motor 6 includes an engine cowling 12 covering the engine 7, and a casing 13 housing the power transmission system. The casing 13 includes an exhaust guide 14 disposed below the engine 7, an upper case 16 disposed below the exhaust guide 14, and a lower case 18 disposed below the upper case 16. The casing 13 further includes an oil pan 15 that stores lubrication oil to be supplied to movable portions such as the engine 7, and a tubular muffler 17 disposed inside of the upper case 16. The exhaust guide 14, defining an engine support member, supports the engine 7 in a posture in which the rotation axis Ac of the crankshaft 33 extends in the up-down direction.

The outboard motor 6 includes an exhaust passage 22 that guides exhaust gases of the engine 7 to an exhaust opening 21 disposed below a waterline WL (a height of a water surface when a vessel equipped with the vessel propulsion apparatus 1 stops). The exhaust passage 22 extends from the engine 7 to the propeller 11. The exhaust passage 22 passes through the insides of the exhaust guide 14, the oil pan 15, the muffler 17, and the lower case 18, and opens at a rear end portion of the propeller 11. The rear end portion of the propeller 11 defines the exhaust opening 21 that opens in water.

The outboard motor 6 further includes an idle exhaust passage 20 that guides exhaust gases of the engine 7 to an idle exhaust opening 19 disposed above the waterline WL. An upstream end of the idle exhaust passage 20 is connected to the exhaust passage 22 at a position lower than the engine 7. The idle exhaust passage 20 extends rearward from the exhaust passage 22 to the idle exhaust opening 19. The idle exhaust opening 19 opens at an outer surface of the outboard motor 6. An opening area of the idle exhaust opening 19 is smaller than that of the exhaust opening 21.

Exhaust gases generated in the engine 7 are guided toward the exhaust opening 21 by the exhaust passage 22. When the output of the engine 7 is high, exhaust gases inside of the exhaust passage 22 are mainly discharged into the water from the exhaust opening 21. Further, a portion of the exhaust gases inside of the exhaust passage 22 is guided to the idle exhaust opening 19 by the idle exhaust passage 20, and released to the atmosphere from the idle exhaust opening 19. On the other hand, when the output of the engine 7 is low (for example, during idling), the exhaust gas pressure inside of the exhaust passage 22 is low, so that the exhaust gases inside of the exhaust passage 22 are mainly released to the atmosphere through the idle exhaust opening 19.

The outboard motor 6 includes a water inlet 23 that opens at an outer surface of the outboard motor 6, a water pump 24 that takes water as cooling water outside of the outboard motor 6 from the water inlet 23 into the inside of the outboard motor 6, and a cooling water passage 25 that guides water suctioned in the water inlet 23 to the respective portions of the outboard motor 6. The water pump 24 to be driven by the engine 7 is disposed in the cooling water passage 25 provided inside of the outboard motor 6. The cooling water passage 25 extends from the water inlet 23 to the exhaust passage 22, and extends from the exhaust passage 22 to the engine 7. Cooling water inside of the cooling water passage 25 cools members defining the exhaust passage 22, such as the oil pan 15, and then cools the engine 7. The cooling water supplied to the water jacket of the engine 7 is guided to the outside of the outboard motor 6 by the cooling water passage 25.

Figure 2:
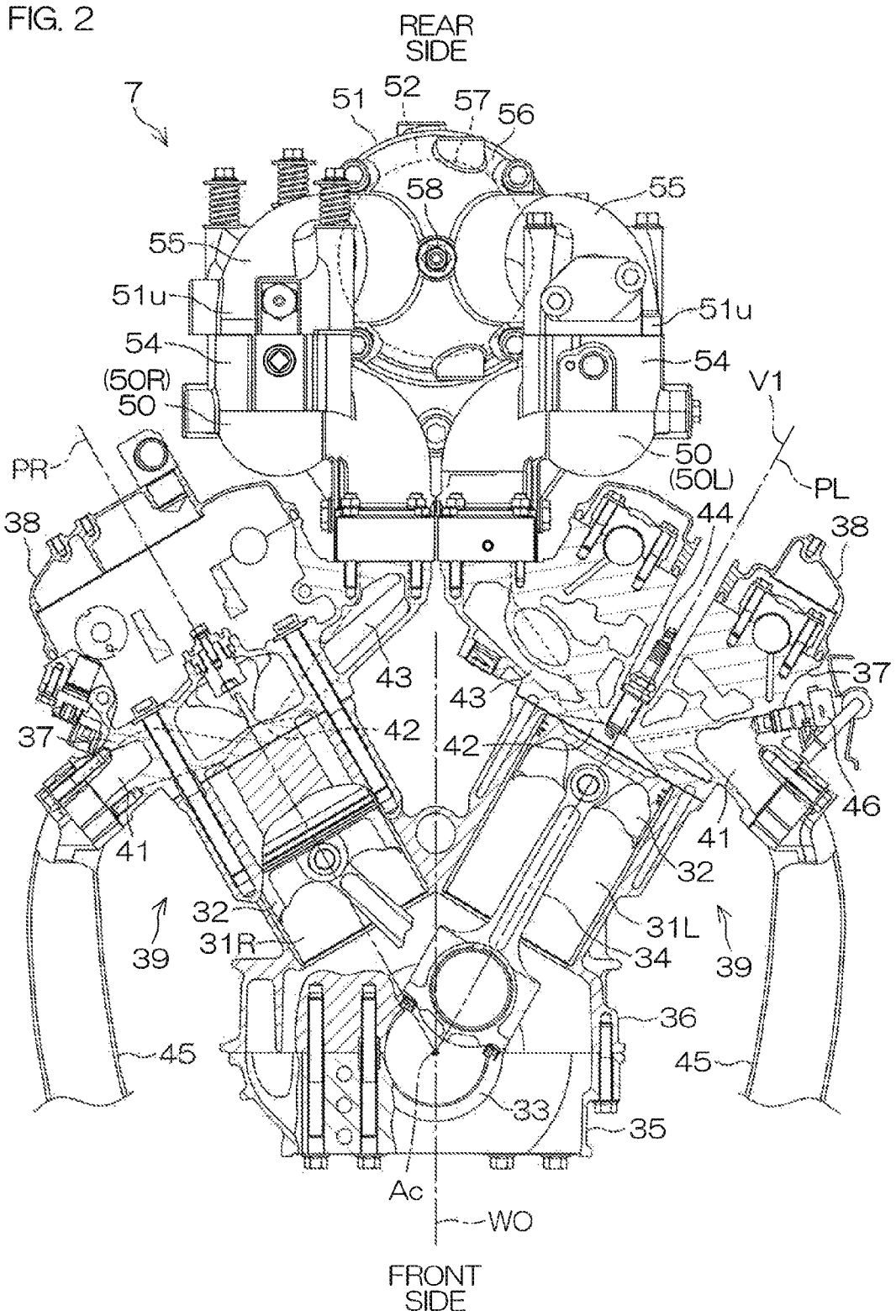
FIG. 2 is a partial sectional view showing a horizontal section of an engine.
Figure 3:
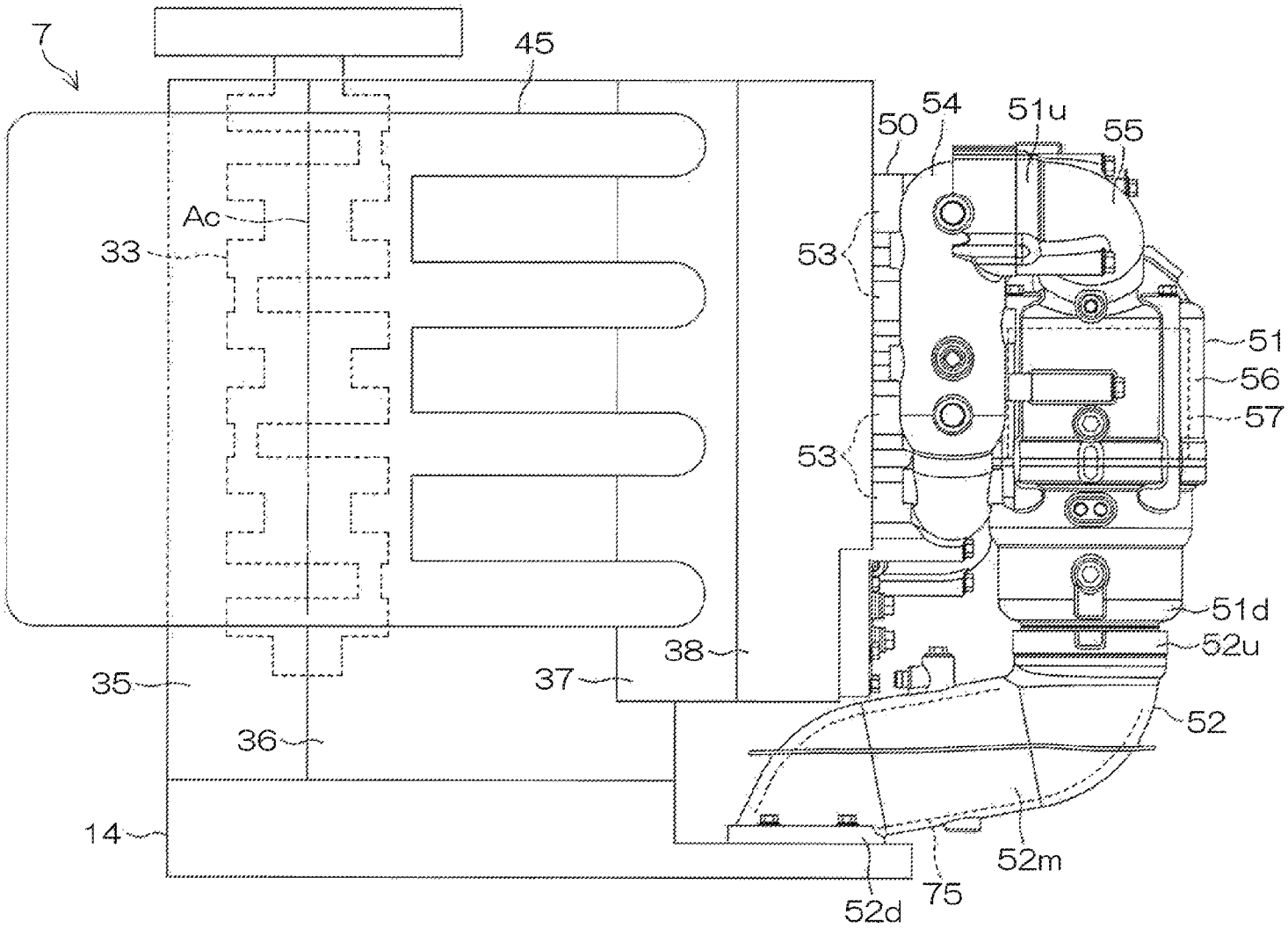
FIG. 3 is a schematic view showing a left side surface of the engine.
Figure 4:
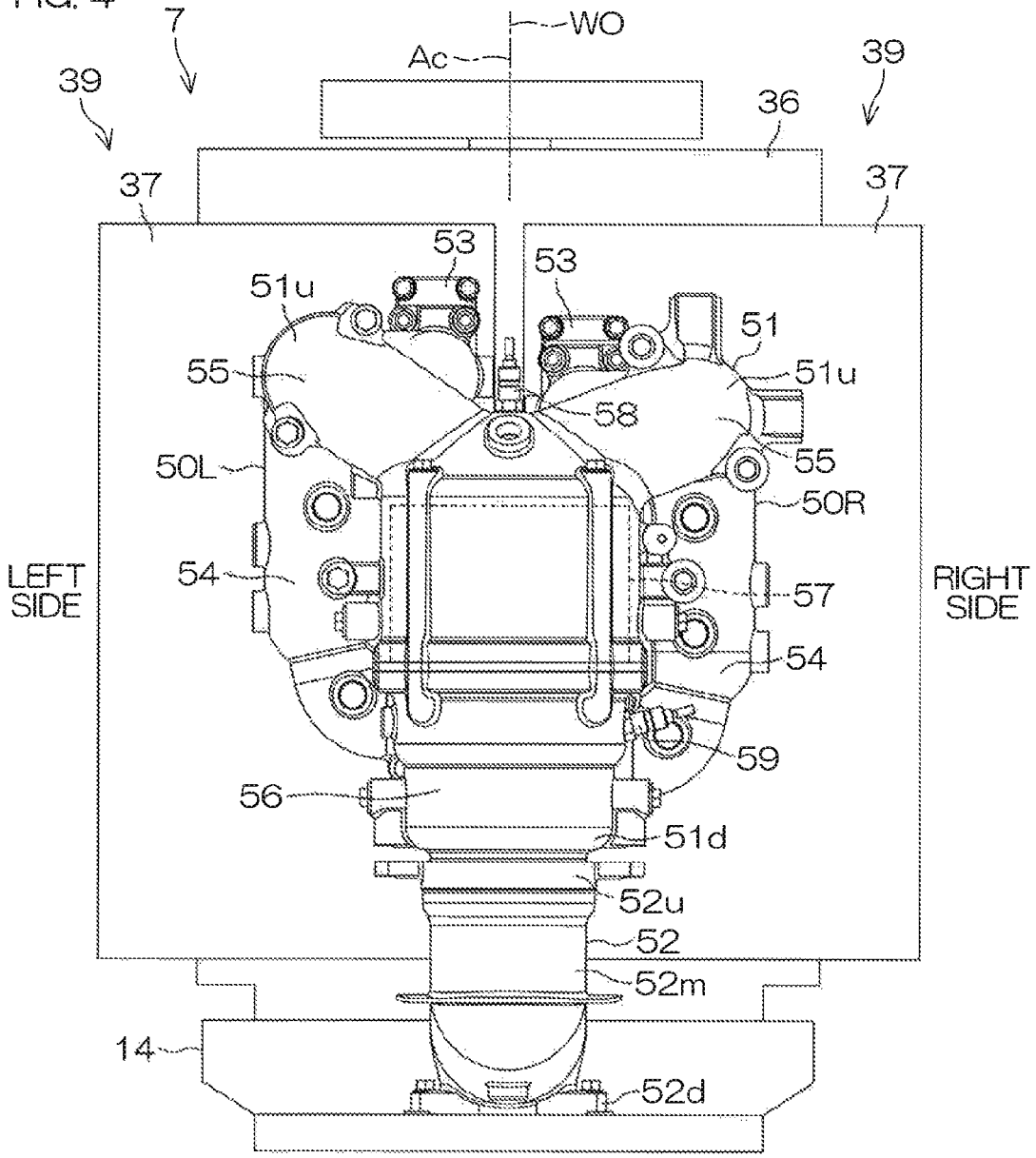
FIG. 4 is a schematic view showing a back surface of the engine.
Figure 5:
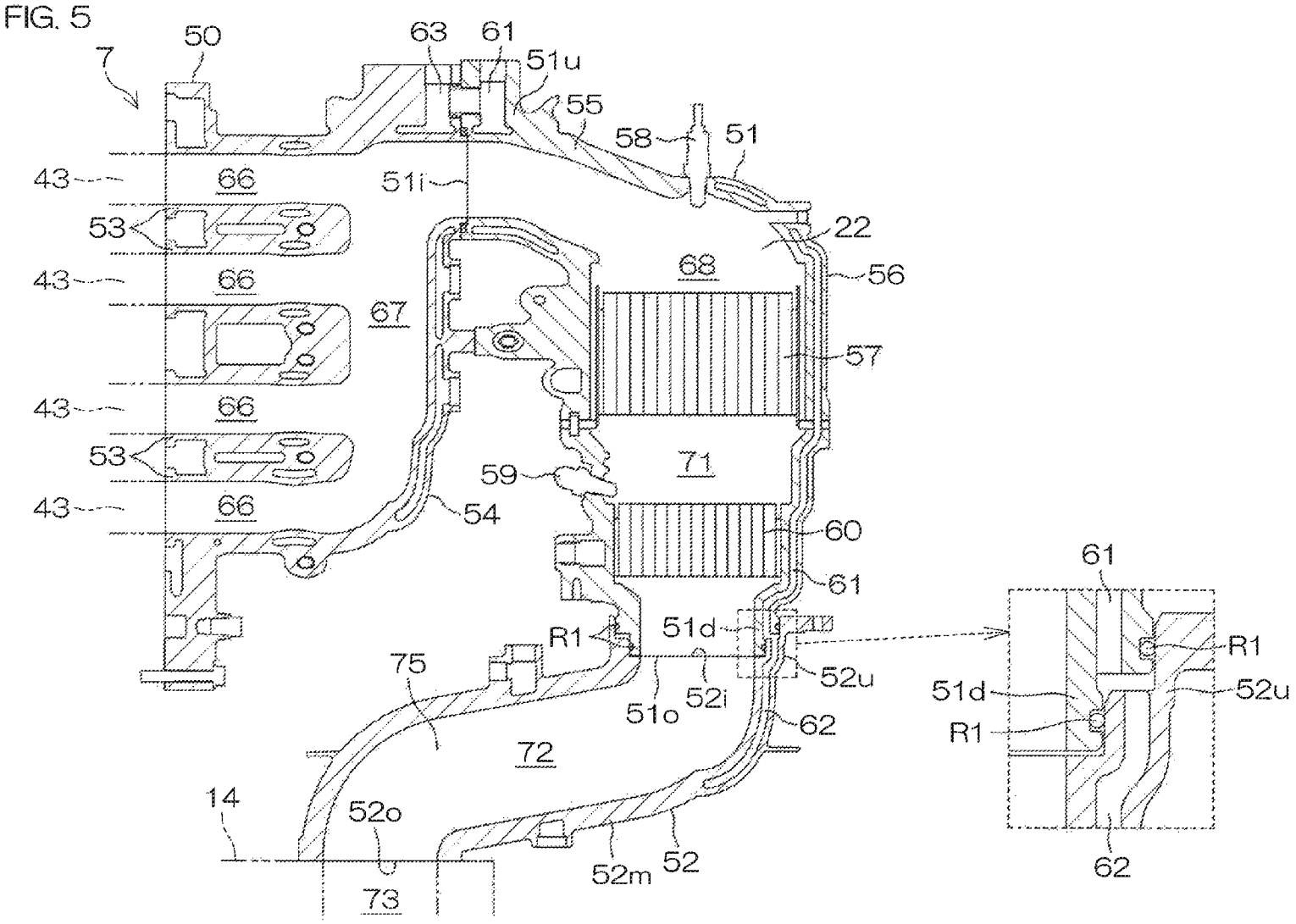
FIG. 5 is a sectional view showing a vertical section of a portion of an exhaust passage.

FIG. 2 is a partial sectional view showing a horizontal section of the engine 7. FIG. 3 is a schematic view showing a left side surface of the engine 7. FIG. 4 is a schematic view showing a back surface of the engine 7. FIG. 5 is a sectional view showing a vertical section of a portion of the exhaust passage 22.

FIG. 2 shows a section that differs in height between the right side and the left side of a center WO (vertical surface that passes through the rotation axis Ac of the crankshaft 33 and is perpendicular or substantially perpendicular to the right-left direction) of the outboard motor 6. In FIG. 3 and FIG. 4, components other than the exhaust manifold 50, the first exhaust pipe 51, and the second exhaust pipe 52, etc., are omitted or simplified.

The engine 7 is, for example, a V-type eight-cylinder four-cycle engine. As shown in FIG. 2, the engine 7 includes a plurality of pistons 32 disposed inside a plurality of cylinders 31, respectively, a crankshaft 33 rotatable around a rotation axis Ac extending in the up-down direction, and a plurality of connecting rods 34 that join the plurality of pistons 32 to the crankshaft 33.

As shown in FIG. 2, the engine 7 includes two cylinder banks 39 provided with the plurality of cylinders 31, and a crankcase 35 attached to the respective cylinder banks 39. The two cylinder banks 39 include a cylinder body 36 having a V-shaped configuration that opens rearward in a plan view of the engine 7, two cylinder heads 37 attached to two rear end portions of the cylinder body 36, respectively, and two head covers 38 attached to the two cylinder heads 37, respectively.

The two cylinder banks 39 are disposed on the right side and the left side of the center WO of the outboard motor 6, respectively. The centerlines of the four cylinders 31 aligned in the right cylinder bank 39 are disposed in a first plane PR parallel or substantially parallel to the rotation axis Ac. The centerlines of the four cylinders 31 aligned in the left cylinder bank 39 are disposed in a second plane PL parallel or substantially parallel to the rotation axis Ac. The first plane PR and the second plane PL are symmetrical or substantially symmetrical about the center WO of the outboard motor 6, and are disposed in a V-shape manner in a plan view of the engine 7. A V-shaped line V1 is defined by the first plane PR and the second plane PL, and extends rearward from the rotation axis Ac.

Hereinafter, "first" and "R" may be attached to the head and the end of an "element corresponding to the right cylinder bank 39," respectively, and "second" and "L" may be attached to the head and the end of an "element corresponding to the left cylinder bank 39," respectively. For example, "cylinder 31 corresponding to the right cylinder bank 39" may be referred to as "first cylinder 31R," and "cylinder 31 corresponding to the left cylinder bank 39" may be referred to as "second cylinder 31L."

As shown in FIG. 2, the cylinder body 36 extends along the V-shaped line V1 in a plan view. The cylinder body 36 defines a plurality of cylinders 31 together with two cylinder heads 37. The two cylinder heads 37 are disposed behind the cylinder body 36, and the crankcase 35 is disposed in front of the cylinder body 36. The crankshaft 33 is disposed inside a housing space defined by the crankcase 35 and the cylinder body 36. As shown in FIG. 3, the crankcase 35 and the cylinder body 36 are disposed on the exhaust guide 14.

As shown in FIG. 2, the two cylinder heads 37 include a plurality of combustion chambers 42 corresponding to the plurality of cylinders 31, respectively, a plurality of intake ports 41 that supply air to the plurality of combustion chambers 42, and a plurality of exhaust ports 43 that discharge exhaust gases generated in the plurality of combustion chambers 42. The engine 7 includes a plurality of ignition plugs 44 that burn an air-fuel mixture in the plurality of combustion chambers 42, a plurality of intake valves that open and close the plurality of intake ports 41, a plurality of exhaust valves that open and close the plurality of exhaust ports 43, and a valve mechanism that moves the pluralities of intake valves and exhaust valves.

The region between the V-shaped line V1 in the right-left direction is inside of the V-shaped line V1, and the right and left regions of the V-shaped line V1 are outside of the V-shaped line V1. The intake ports 41 are disposed outside of the V-shaped line V1, and the exhaust ports 43 are disposed inside of the V-shaped line V1. The plurality of intake ports 41 are connected to the plurality of combustion chambers 42, respectively, and the plurality of exhaust ports 43 are connected to the plurality of combustion chambers 42, respectively.

An intake system of the engine 7 includes two intake manifolds 45 that supply air to the plurality of combustion chambers 42 via the plurality of intake ports 41. A fuel supply system of the engine 7 includes a fuel injector 46 that supplies fuel to the plurality of combustion chambers 42. An exhaust system of the engine 7 includes two exhaust manifolds 50 that discharge exhaust gases generated in the plurality of combustion chambers 42 from the plurality of combustion chambers 42 via the plurality of exhaust ports 43, and a first exhaust pipe 51 connected to the two exhaust manifolds 50. As shown in FIG. 3 and FIG. 4, the exhaust system of the engine 7 further includes a second exhaust pipe 52 connected to the first exhaust pipe 51.

As shown in FIG. 2, the intake manifolds 45 and the fuel injector 46 are disposed outside of the V-shaped line V1. The exhaust manifolds 50, the first exhaust pipe 51, and the second exhaust pipe 52 are disposed inside of the V-shaped line V1. The two exhaust manifolds 50 are disposed behind the two cylinder heads 37, respectively. The two exhaust manifolds 50 are preferably independent of each other, and are arranged side by side in the right-left direction. The first exhaust pipe 51 is disposed behind the two exhaust manifolds 50.

As shown in FIG. 3 and FIG. 4, the second exhaust pipe 52 is disposed below the first exhaust pipe 51. The second exhaust pipe 52 extends from the first exhaust pipe 51 to the exhaust guide 14. The exhaust manifolds 50 and the first exhaust pipe 51 are disposed higher than the exhaust guide 14. The second exhaust pipe 52 is separated from the engine main body including the cylinder heads 37 and the cylinder body 36.

The two exhaust manifolds 50 are fixed to the two cylinder heads 37 by, for example, a plurality of bolts, respectively. The two upstream end portions 51*u* of the first exhaust pipe 51 are joined to the two exhaust manifolds 50 by, for example, a plurality of bolts, respectively. The upstream end portion 52*u* of the second exhaust pipe 52 is joined to the downstream end portion 51*d* of the first exhaust pipe 51 via two O-rings R1 (refer to FIG. 5). The downstream end portion 52*d* of the second exhaust pipe 52 is fixed to the exhaust guide 14 by, for example, a plurality of bolts.

As shown in FIG. 5, each of the two exhaust manifolds 50 includes a plurality of upstream branch portions 53 connected to the plurality of exhaust ports 43, and an upstream collecting portion 54 connected to the respective upstream branch portions 53. As shown in FIG. 4, the first exhaust pipe 51 includes two downstream branch portions 55 connected to the two upstream collecting portions 54, respectively, and a downstream collecting portion 56 connected to the respective downstream branch portions 55. The second exhaust pipe 52 includes an upstream end portion 52*u* connected to the downstream collecting portion 56, and a downstream end portion 52*d* connected to the exhaust guide 14. As shown in FIG. 3, the second exhaust pipe 52 further includes a midstream portion 52*m* extending toward the crankshaft 33 from the upstream end portion 52*u* of the second exhaust pipe 52 to the downstream end portion 52*d* of the second exhaust pipe 52 in a side view.

As shown in FIG. 5, an inlet 51*i* of the first exhaust pipe 51 is disposed higher than an outlet 510 of the first exhaust pipe 51. The outlet 510 of the first exhaust pipe 51 is positioned below a catalyst 57. A diameter of the outlet 510 of the first exhaust pipe 51 is larger than a diameter of the inlet 51*i* of the first exhaust pipe 51. A diameter of an inlet 52*i* of the second exhaust pipe 52 and a diameter of an outlet 52*o* of the second exhaust pipe 52 are larger than the diameter of the inlet 51*i* of the first exhaust pipe 51. The inlet 52*i* of the second exhaust pipe 52 is disposed farther to the rear than the exhaust guide 14. The outlet 52*o* of the second exhaust pipe 52 is disposed above the exhaust guide 14.

The engine 7 includes the catalyst 57 disposed inside of the exhaust passage 22, an upstream sensor 58 that measures an exhaust gas concentration at a position farther upstream than the catalyst 57, and a downstream sensor 59 that measures an exhaust gas concentration at a position farther downstream than the catalyst 57. The engine 7 further includes a water-resistant member 60 disposed inside of the exhaust passage 22 at a position farther downstream than the downstream sensor 59. The catalyst 57, the upstream sensor 58, the downstream sensor 59, and the water-resistant member 60 are held by the first exhaust pipe 51.

The catalyst 57 is, for example, a three-way catalyst. The catalyst 57 is disposed in a catalyst housing portion provided in the downstream collecting portion 56 of the first exhaust pipe 51. The catalyst 57 is disposed inside a downstream collecting passage 68 of the exhaust passage 22 described below. An outer peripheral portion of the catalyst 57 surrounds the centerline of the exhaust passage 22, and is preferably concentric with the exhaust passage 22. The catalyst 57 includes a honeycomb carrier inside which exhaust gases pass through and a catalytic material on the surface of the carrier.

The catalyst 57 is disposed higher than the exhaust guide 14. The catalyst 57 is disposed at a height lower than the upper end of the plurality of first cylinders 31R and higher than the lower end of the plurality of first cylinders 31R (refer to FIG. 6). The water-resistant member 60 is disposed below the catalyst 57. The upstream sensor 58 is disposed above the catalyst 57, and the downstream sensor 59 is disposed at a height between the catalyst 57 and the water-resistant member 60. Tip end portions of the upstream sensor 58 and the downstream sensor 59 project inward from an inner surface of the first exhaust pipe 51.

Each of the upstream sensor 58 and the downstream sensor 59 are oxygen concentration sensors that detect an oxygen concentration in the exhaust gases. Exhaust gases flowing in the exhaust passage 22 come into contact with the tip end portions of the upstream sensor 58 and the downstream sensor 59. The upstream sensor 58 detects an oxygen concentration in the exhaust gases before being purified by the catalyst 57, and the downstream sensor 59 detects an oxygen concentration in the exhaust gases after being purified by the catalyst 57. An air-fuel ratio of the air-fuel mixture to be supplied to the combustion chambers 42 is controlled by an engine control system based on detection values of the upstream sensor 58 and the downstream sensor 59, etc.

The exhaust opening 21 defined by the propeller 11 is disposed in water, so that water enters the inside of the exhaust passage 22 through the exhaust opening 21. When the pressure inside of the combustion chambers 42 becomes negative (pressure lower than the atmospheric pressure), water inside of the exhaust passage 22 may flow backward in the exhaust passage 22 toward the combustion chambers 42. The water-resistant member 60 has a honeycomb shape that allows gases to pass through and blocks distribution of liquids. Therefore, even if water inside of the exhaust passage 22 reaches the water-resistant member 60, a backward flow of the water is blocked by the water-resistant member 60. Accordingly, an amount of water that moves to a position farther upstream than the water-resistant member 60 is reduced, and the catalyst 57, the upstream sensor 58, and the downstream sensor 59 are prevented from getting wet.

The tubular downstream end portion 51*d* of the first exhaust pipe 51 and the tubular upstream end portion 52*u* of the second exhaust pipe 52 are joined by fitting. FIG. 5 shows an example in which the downstream end portion 51*d* of the first exhaust pipe 51 is inserted inside of the upstream end portion 52*u* of the second exhaust pipe 52. However, the upstream end portion 52*u* of the second exhaust pipe 52 may be inserted inside of the downstream end portion 51*d* of the first exhaust pipe 51. A gap between the first exhaust pipe 51 and the second exhaust pipe 52 is sealed by two O-rings R1 spaced from each other in the axial direction of the exhaust passage 22. Accordingly, exhaust gases are prevented from leaking from the gap between the first exhaust pipe 51 and the second exhaust pipe 52.

The cooling water passage 25 includes a first water passage 61 provided in the first exhaust pipe 51, a second water passage 62 provided in the second exhaust pipe 52, and two third water passages 63 provided in the two exhaust manifolds 50. As shown in an enlarged manner in FIG. 5, the first water passage 61 opens at the downstream end portion 51*d* of the first exhaust pipe 51, and the second water passage 62 opens at the upstream end portion 52*u* of the second exhaust pipe 52. The downstream end portion 51*d* of the first exhaust pipe 51 and the upstream end portion 52*u* of the second exhaust pipe 52 define an annular sealed space surrounding the exhaust passage 22 together with the two O-rings R1. The opening of the first water passage 61 and the opening of the second water passage 62 are disposed in this sealed space.

The first water passage 61 is connected to the second water passage 62 by a connecting portion between the first exhaust pipe 51 and the second exhaust pipe 52. The first water passage 61 is further connected to the third water passage 63 by a connecting portion between the first exhaust pipe 51 and the first exhaust manifold 50R and connected to the third water passage 63 by a connecting portion between the first exhaust pipe 51 and the second exhaust manifold 50L. Cooling water fed by the water pump 24 (refer to FIG. 1) flows from the second water passage 62 to the first water passage 61, and flows from the first water passage 61 to the third water passages 63. Therefore, a plurality of members including the first exhaust pipe 51 and the second exhaust pipe 52 are cooled by the same cooling water. In addition, while the cooling water is prevented from leaking by the two O-rings R1, the cooling water is distributed between the first water passage 61 and the second water passage 62.

Figure 6:
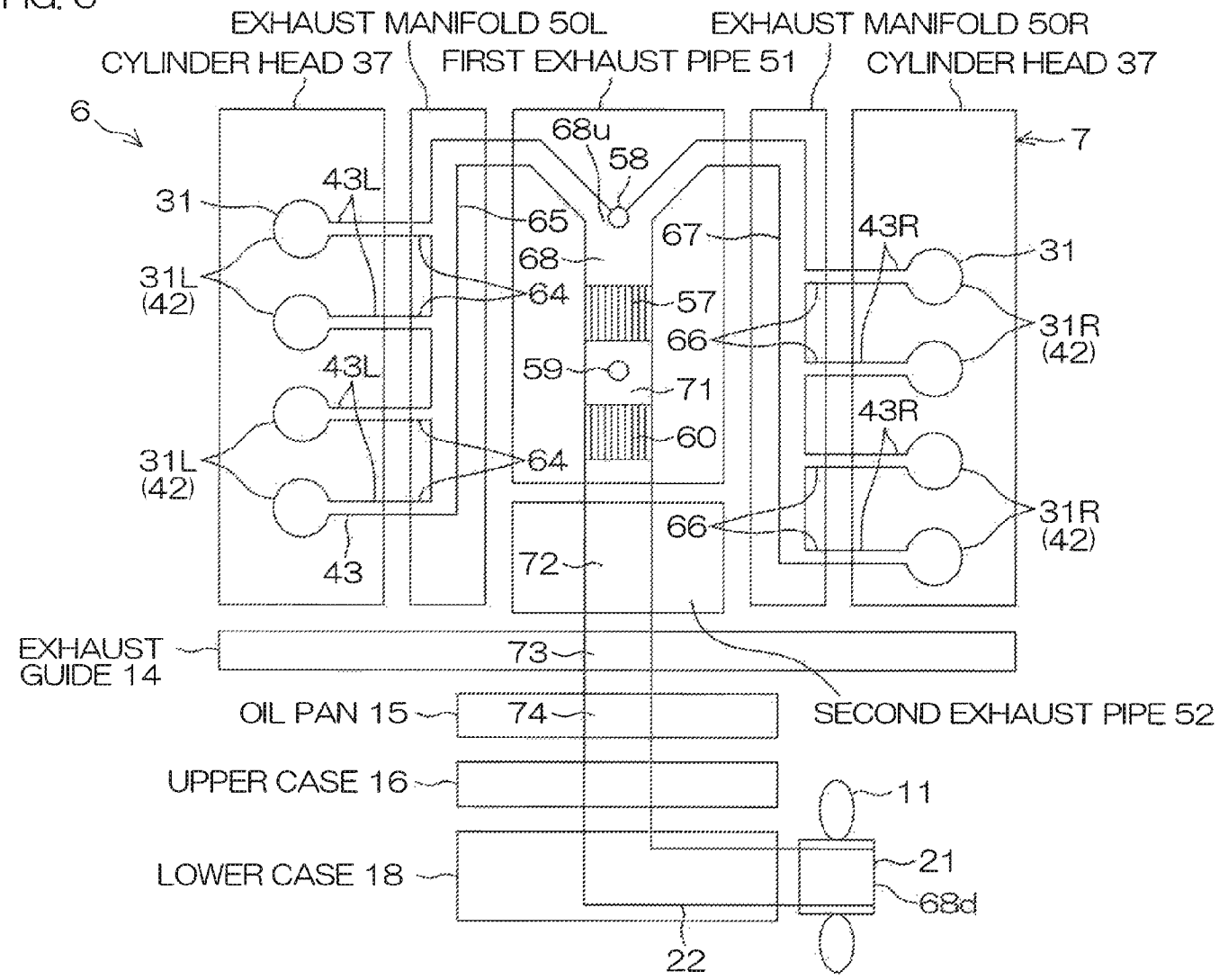
FIG. 6 is a conceptual diagram showing the entire exhaust passage.

FIG. 6 is a conceptual diagram showing the entire exhaust passage 22. Hereinafter, the exhaust passage 22 is described with reference to FIG. 5 and FIG. 6.

The exhaust passage 22 includes a plurality of branch passages 66 extending downstream from a plurality of first exhaust ports 43R corresponding to the plurality of first cylinders 31R, respectively, and a first upstream collecting passage 67 extending downstream from each of the first branch passages 66. Similarly, the exhaust passage 22 includes a plurality of second branch passages 64 extending downstream from a plurality of exhaust ports 43L corresponding to the plurality of second cylinders 31L, respectively, and a second upstream collecting passage 65 extending downstream from each of the second branch passages 64. The exhaust passage 22 further includes a downstream collecting passage 68 extending downstream from each of the first upstream collecting passage 67 and the second upstream collecting passage 65.

The first branch passages 66 are defined by the upstream branch portions 53 of the first exhaust manifold 50R. The second branch passages 64 are defined by the upstream branch portions 53 of the second exhaust manifold 50L. The plurality of first branch passages 66 join together inside of the first exhaust manifold 50R, and the plurality of second branch passages 64 join together inside of the second exhaust manifold 50L. The two exhaust manifolds 50 are disposed inside of the V-shaped line V1, so that the first branch passages 66 and the second branch passages 64 are positioned inside of the V-shaped line V1.

The first upstream collecting passage 67 is defined by the upstream collecting portion 54 of the first exhaust manifold 50R and one downstream branch portion 55 of the first exhaust pipe 51. The second upstream collecting passage 65 is defined by the upstream collecting portion 54 of the second exhaust manifold 50L and the other downstream branch portion 55 of the first exhaust pipe 51. The first upstream collecting passage 67 and the second upstream collecting passage 65 are positioned inside of the V-shaped line V1. The first upstream collecting passage 67 and the second upstream collecting passage 65 join together inside of the first exhaust pipe 51. The first upstream collecting passage 67 and the second upstream collecting passage 65 define a Y-shaped passage having a Y shape in a rear view of the exhaust passage 22 together with the downstream collecting passage 68.

The downstream collecting passage 68 extends from the junction of the first upstream collecting passage 67 and the second upstream collecting passage 65 to the exhaust opening 21 open at the propeller 11 through the inside of the casing 13 including the exhaust guide 14 and the oil pan 15. The downstream collecting passage 68 includes a first passage 71 defined by the downstream collecting portion 56 of the first exhaust pipe 51, a second passage 72 defined by the second exhaust pipe 52, a third passage 73 defined by the exhaust guide 14, and a fourth passage 74 defined by the oil pan 15. The second passage 72 includes an approaching portion 75 (refer to FIG. 3) that extends toward the crankshaft 33 while extending downstream in the flow direction of exhaust gases. The approaching portion 75 is disposed higher than the exhaust guide 14.

Exhaust gases generated in the two cylinder heads 37 are discharged to the two exhaust manifolds 50 disposed inside of the V-shaped line V1. Exhaust gases discharged to the two exhaust manifolds 50 flow inside of the first exhaust pipe 51 and are purified by the catalyst 57. The exhaust gases purified inside of the first exhaust pipe 51 pass through the second exhaust pipe 52, the exhaust guide 14, the oil pan 15, the upper case 16, and the lower case 18 in this order, and are discharged into water from the propeller 11. Accordingly, exhaust gases generated in the plurality of cylinders 31 are discharged into the water.

As described above, in the present preferred embodiment, each of the first upstream collecting passage 67 and the second upstream collecting passage 65 are connected just by one downstream collecting passage 68 to the exhaust opening 21 disposed in the water. Therefore, a pressure loss of exhaust gases due to branching of the exhaust passage 22 is reduced. Further, a portion from the upstream end 68*u* of the downstream collecting passage 68 to the downstream end 68*d* of the downstream collecting passage 68 is disposed outside of the cylinder body 36 and the cylinder heads 37, so that without being constrained by the cylinder body 36 and the cylinder heads 37, the flow passage area of the downstream collecting passage 68 increases. Accordingly, the output and fuel consumption of the engine 7 are improved.

In the present preferred embodiment, exhaust gases generated in any of the cylinders 31 are collected at the downstream collecting passage 68. The catalyst 57 that purifies exhaust gases are disposed in the downstream collecting passage 68. Therefore, exhaust gases generated in all cylinders 31 are treated with one catalyst 57. Further, the catalyst 57 is disposed inside of the V-shaped line V1, so that as compared with the case where the catalyst 57 is disposed outside of the V-shaped line V1, the widths of the engine 7 and the catalyst 57 are reduced.

Further, in the present preferred embodiment, the catalyst 57 is disposed at a height between the upper end of the plurality of first cylinders 31R and the lower end of the plurality of first cylinders 31R. Thus, the catalyst 57 is disposed near the engine 7, exhaust gases having a high-temperature pass through the catalyst 57. Therefore, the temperature of the catalyst 57 is raised to a temperature at which the catalyst is highly active in a short period of time when starting the engine 7. Further, the catalyst 57 is disposed at a high position, so that even if water flows back inside of the exhaust passage 22, water hardly reaches the catalyst 57.

In the present preferred embodiment, cooling water suctioned into the water pump 24 is guided by the cooling water passage 25 from the water pump 24 to the exhaust passage 22, and then guided by the cooling water passage 25 from the exhaust passage 22 to the engine 7. That is, the exhaust passage 22 is cooled by cooling water before cooling the cylinder heads 37, etc. The members defining the exhaust passage 22 normally have a heat capacity smaller than that of the engine 7. Therefore, by supplying low-temperature cooling water to the exhaust passage 22, an increase in the temperature of the exhaust passage 22 is reduced.

Although preferred embodiments of the present invention have been described above, the present invention is not restricted to the contents of the preferred embodiments and various modifications are possible within the scope of the present invention.

For example, the total number of cylinders 31 provided in the engine 7 is not limited to 8, and may be 6.

In the above-described preferred embodiments, a case where the oil pan 15 is preferably disposed above the upper case 16 is described. However, the oil pan 15 may be disposed inside of the upper case 16. In this case, the oil pan 15 may be integral and unitary with the upper case 16.

At least a portion of the exhaust manifold 50 may be integral and unitary with the cylinder head 37. For example, the plurality of upstream branch portions 53 of the exhaust manifold 50 may be integral and unitary with the cylinder head 37, and the upstream collecting portion 54 of the exhaust manifold 50 may be fixed to the cylinder head 37 by fixing members such as bolts.

The outboard motor 6 may include a plurality of catalysts 57. On the contrary, the outboard motor 6 may not include any catalysts 57. Similarly, the outboard motor 6 may not include the water-resistant member 60.

The exhaust sensor (the upstream sensor 58 and the downstream sensor 59) may be provided only upstream of the catalyst 57. The exhaust sensor is not limited to an oxygen concentration sensor, but may be a temperature sensor that detects a temperature of the exhaust gases.

The catalyst 57 is not limited to being disposed inside of the V-shaped line V1, but may be disposed outside of the V-shaped line V1. The position of the catalyst 57 in the up-down direction is not limited to a position between the upper end of the plurality of first cylinders 31R and the lower end of the plurality of first cylinders 31R, but may be a position lower than the lower end of the plurality of first cylinders 31R.

The downstream collecting passage 68 may not include the approaching portion 75 that extends towards the crankshaft 33 while extending downstream in the flow direction of exhaust gases. In detail, in a case where the exhaust guide 14 is disposed below the first exhaust pipe 51, the second exhaust pipe 52 may be a straight pipe extending from the first exhaust pipe 51 to the exhaust guide 14.

The first water passage 61 provided in the first exhaust pipe 51 and the second water passage 62 provided in the second exhaust pipe 52 may not be connected by the connecting portion between the first exhaust pipe 51 and the second exhaust pipe 52. In detail, two water supply channels to supply cooling water to the first water passage 61 and the second water passage 62, respectively, may be provided in the cooling water passage 25.

In the above-described preferred embodiments, the case where the second exhaust pipe 52 is preferably a member separate from the first exhaust pipe 51 and the exhaust guide 14 is described. However, at least a portion of the second exhaust pipe 52 may be integral and unitary with the exhaust guide 14.

Figure 7:
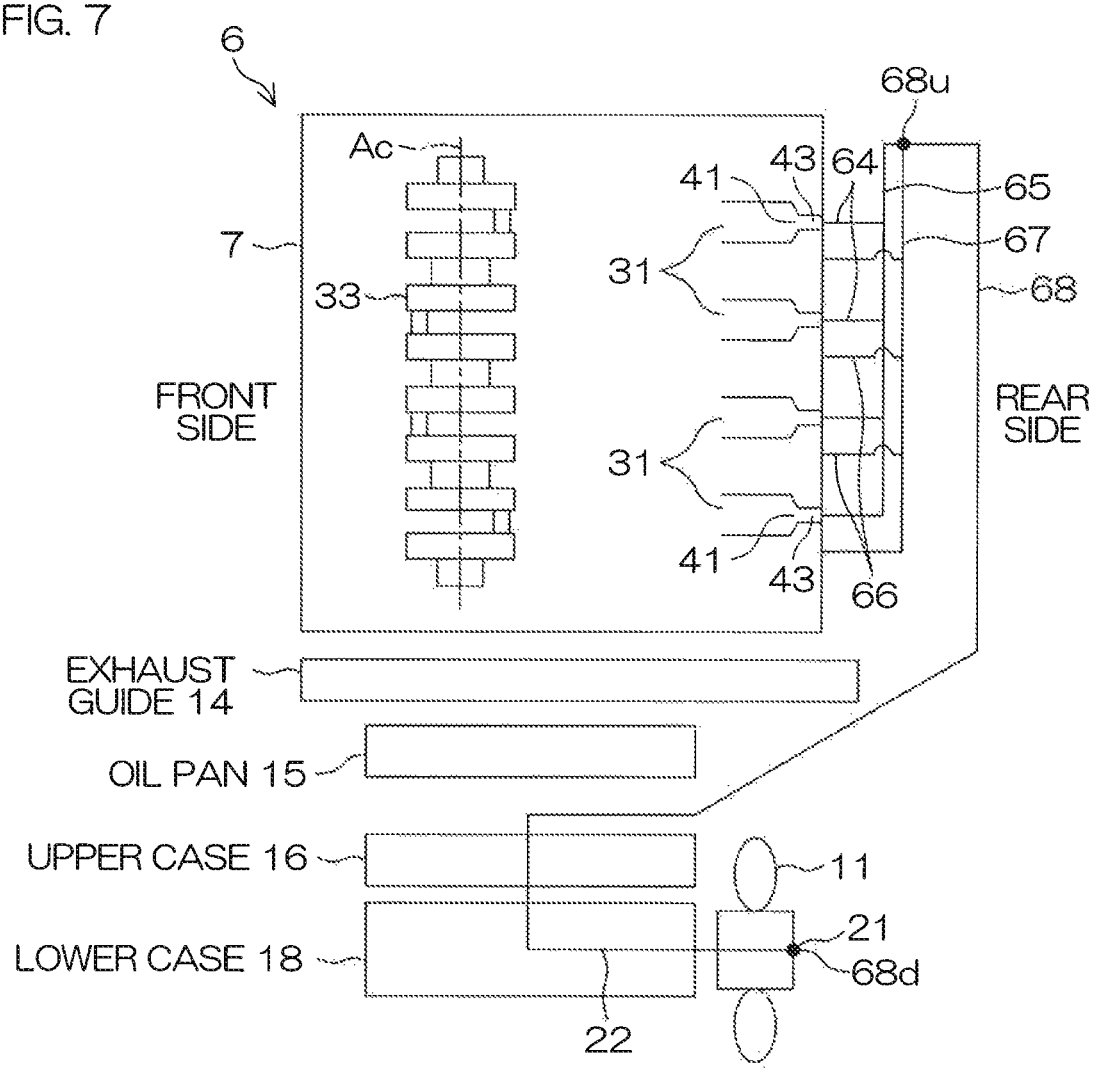
FIG. 7 is a conceptual diagram showing the entire exhaust passage according to another preferred embodiment of the present invention.

In the above-described preferred embodiments, the case where the downstream collecting passage 68 preferably passes through the insides of the exhaust guide 14 and the oil pan 14 is described. However, the downstream collecting passage 68 may be disposed outside at least one of the exhaust guide 14 and the oil pan 15. For example, as shown in FIG. 7, a portion from the upstream end 68*u* of the downstream collecting passage 68 to the downstream end 68*d* of the downstream collecting passage 68 may be disposed outside both of the exhaust guide 14 and the oil pan 15. With this arrangement, the downstream collecting passage 68 is arranged separately from the exhaust guide 14 and the oil pan 15.

Also, features of two or more of the various preferred embodiments described above may be combined.

The present application claims priority to Japanese Patent Application No. 2015-040508 filed on Mar. 2, 2015 in the Japan Patent Office, and the entire disclosure of this application is incorporated herein by reference.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an engine including a V-shaped cylinder body disposed along a V-shaped line defined by a first plane passing through centerlines of a plurality of first cylinders and a second plane passing through centerlines of a plurality of second cylinders, and two cylinder heads including a plurality of combustion chambers; and an exhaust passage that discharges exhaust gases generated in the engine into water from an exhaust opening; wherein the exhaust passage includes:

a plurality of first branch passages connected to the plurality of first cylinders, respectively, and disposed inside of the V-shaped line;

a plurality of second branch passages connected to the plurality of second cylinders, respectively, and disposed inside of the V-shaped line;

a first upstream collecting passage connected to each of the plurality of first branch passages;

a second upstream collecting passage connected to each of the plurality of second branch passages; and a downstream collecting passage including an upstream end connected to each of the first upstream collecting passage and the second upstream collecting passage, and a downstream end connected to the exhaust opening;

a portion of the downstream collecting passage extending from the upstream end to the downstream end is disposed outside of the two cylinder heads; and the upstream end of the downstream collecting passage is disposed behind the two cylinder heads.

2. The outboard motor according to claim 1, further comprising a catalyst disposed in the downstream collecting passage.

3. The outboard motor according to claim 2, wherein the catalyst is disposed inside of the V-shaped line.

4. The outboard motor according to claim 2, wherein the catalyst is disposed at a height lower than an upper end of the plurality of first cylinders and higher than a lower end of the plurality of first cylinders.

5. The outboard motor according to claim 1, wherein the engine further includes a crankshaft rotatable around a rotation axis extending in an up-down direction; and the downstream collecting passage includes an approaching portion that extends toward the crankshaft while extending downstream with respect to a flow direction of exhaust gases.

6. An outboard motor comprising:

an engine including a V-shaped cylinder body disposed along a V-shaped line defined by a first plane passing through centerlines of a plurality of first cylinders and a second plane passing through centerlines of a plurality of second cylinders, and two cylinder heads including a plurality of combustion chambers;

an exhaust passage that discharges exhaust gases generated in the engine into water from an exhaust opening;

the exhaust passage includes:

a plurality of first branch passages connected to the plurality of first cylinders, respectively, and disposed inside of the V-shaped line;

a plurality of second branch passages connected to the plurality of second cylinders, respectively, and disposed inside of the V-shaped line;

a first upstream collecting passage connected to each of the plurality of first branch passages;

a second upstream collecting passage connected to each of the plurality of second branch passages; and a downstream collecting passage including an upstream end connected to each of the first upstream collecting passage and the second upstream collecting passage, and a downstream end connected to the exhaust opening;

a portion of the downstream collecting passage extending from the upstream end to the downstream end is disposed outside of the two cylinder heads;

a cooling water passage that guides cooling water to cool the outboard motor; and a first exhaust pipe and a second exhaust pipe that define portions of the downstream collecting passage and include connecting portions that are connected to each other; wherein the cooling water passage includes a first water passage in the first exhaust pipe and a second water passage in the second exhaust pipe; and the first water passage and the second water passage are connected to each other at the connecting portions of the first exhaust pipe and the second exhaust pipe.

7. The outboard motor according to claim 6, further comprising:

a water pump that feeds cooling water into the cooling water passage; wherein the cooling water passage extends from the water pump to the engine via the exhaust passage.

8. An outboard motor comprising:

an engine including a V-shaped cylinder body disposed along a V-shaped line defined by a first plane passing through centerlines of a plurality of first cylinders and a second plane passing through centerlines of a plurality of second cylinders, and two cylinder heads including a plurality of combustion chambers;

an exhaust passage that discharges exhaust gases generated in the engine into water from an exhaust opening; and an engine support member that supports the V-shaped cylinder body of the engine; wherein the exhaust passage includes:

a plurality of first branch passages connected to the plurality of first cylinders, respectively, and disposed inside of the V-shaped line;

a plurality of second branch passages connected to the plurality of second cylinders, respectively, and disposed inside of the V-shaped line;

a first upstream collecting passage connected to each of the plurality of first branch passages;

a second upstream collecting passage connected to each of the plurality of second branch passages; and a downstream collecting passage including an upstream end connected to each of the first upstream collecting passage and the second upstream collecting passage, and a downstream end connected to the exhaust opening;

a portion of the downstream collecting passage extending from the upstream end to the downstream end is disposed outside of the two cylinder heads; and the engine support member defines a portion of the downstream collecting passage.

9. An outboard motor comprising:

an engine including a V-shaped cylinder body disposed along a V-shaped line defined by a first plane passing through centerlines of a plurality of first cylinders and a second plane passing through centerlines of a plurality of second cylinders, and two cylinder heads including a plurality of combustion chambers;

an exhaust passage that discharges exhaust gases generated in the engine into water from an exhaust opening; and an engine support member that supports the V-shaped cylinder body of the engine; wherein the exhaust passage includes:

a plurality of first branch passages connected to the plurality of first cylinders, respectively, and disposed inside of the V-shaped line;

a plurality of second branch passages connected to the plurality of second cylinders, respectively, and disposed inside of the V-shaped line;

a first upstream collecting passage connected to each of the plurality of first branch passages;

a second upstream collecting passage connected to each of the plurality of second branch passages; and a downstream collecting passage including an upstream end connected to each of the first upstream collecting passage and the second upstream collecting passage, and a downstream end connected to the exhaust opening;

a portion of the downstream collecting passage extending from the upstream end to the downstream end is disposed outside of the two cylinder heads; and the portion from the upstream end to the downstream end of the downstream collecting passage is disposed outside of the engine support member.

10. The outboard motor according to claim 1, further comprising:

an oil pan disposed below the engine; wherein the portion from the upstream end to the downstream end of the downstream collecting passage is disposed outside of the oil pan.

* * * * *